US005620043A

United States Patent [19]

Chamarro et al.

[11] Patent Number: 5,620,043

[45] Date of Patent: Apr. 15, 1997

[54] TRANSFERRING MOLTEN METAL FOR LOW PRESSURE CASTING

[75] Inventors: Mark A. Chamarro, Oxford, Mich.; Kenneth D. Clark, Santa Rosa, Calif.

[73] Assignee: Ford Motor Company, Dearborn, Mich.

[21] Appl. No.: 488,890

[22] Filed: Jun. 9, 1995

[51] Int. Cl.[6] ..... B22D 18/04; B22D 17/06

[52] U.S. Cl. ..... 164/119; 164/306

[58] Field of Search ..... 164/119, 306

[56] References Cited

U.S. PATENT DOCUMENTS

| | | | |
|---|---|---|---|
| 3,508,615 | 4/1970 | Troy . | |
| 4,733,714 | 3/1988 | Smith . | |
| 5,178,203 | 1/1993 | Kuhn et al. . | |
| 5,205,346 | 4/1993 | Kuhn et al. . | |
| 5,217,058 | 6/1993 | Sourlier . | |

FOREIGN PATENT DOCUMENTS

| | | | |
|---|---|---|---|
| 3824609 | 7/1988 | Germany . | |
| 3824609 | 1/1990 | Germany | 164/119 |
| 4204262 | 8/1993 | Germany | 164/306 |
| 57-154366 | 9/1982 | Japan | 164/306 |
| 58-13463 | 1/1983 | Japan | 164/306 |
| 58-148070 | 9/1983 | Japan . | |
| 60-180657 | 9/1985 | Japan . | |
| 61-199565 | 9/1986 | Japan . | |
| 2-160160 | 6/1990 | Japan . | |
| 4-327356 | 11/1992 | Japan | 164/119 |
| 5-123851 | 5/1993 | Japan | 164/119 |
| 789239 | 12/1978 | U.S.S.R. . | |
| 1135546A | 1/1985 | U.S.S.R. . | |

*Primary Examiner*—Joseph J. Hail, III
*Assistant Examiner*—I.-H. Lin
*Attorney, Agent, or Firm*—Joseph W. Malleck

[57] ABSTRACT

A transfer system for delivering molten metal against gravity from a pressurized furnace to a mold, comprising: a ceramic lined refractory metal gatebox adapted to sit on or above the furnace, the gatebox having one or more openings at its top for communicating with the mold and having a plurality of metal transfer openings along its bottom; a stalk tube depending from each of the gatebox bottom openings, each stalk tube being effective to extend into at least the upper region of the molten metal within the furnace; a sealing gasket between the stalk tube and gatebox; imposing a first fluid pressure on the molten metal in the furnace to gradually force the molten metal up through the stalk tubes into the gatebox to substantially fill same, said stalk tubes promoting a convection circulation of metal between molten metal between the furnace and gatebox to retain the temperature of the molten metal in the gatebox at a difference of no greater than 15°–15° F. without the need for external heating; and imposing a second fluid pressure on the molten metal in the furnace to quiescently force the molten metal of the substantially filled gatebox into the mold with little or no momentum effect.

7 Claims, 3 Drawing Sheets

TRANSFERRING MOLTEN METAL FOR LOW PRESSURE CASTING

BACKGROUND OF THE INVENTION

1. Technical Field

This invention relates to the technology for moving molten metal from a heated molten furnace to a die cavity by use of low pressure in the furnace.

2. Discussion of the Prior Art

Casting systems that deliver molten metal against the force of gravity generally fall into two categories: pneumatic or electromagnetic pumping. Such systems are particularly useful for casting complex or thin-sectioned articles as the metal will be delivered slowly and tranquilly. The pneumatic type is of importance because of its better reliability, ease of maintenance and minimal experimentation. The metal is pressurized in the furnace with air or other gases to develop a differential pressure between the furnace and mold, which differential pressure forces the metal from the furnace into the mold. Such pneumatic systems are difficult to precisely control because (i) any changes, in the metal flow into the mold, are countered by the momentum of the remaining pressurized supply of the entire furnace, (ii) by the necessity of returning the unused metal supply to the furnace which retransfer may lead to additional oxidation or solution of contaminated gases, and (iii) by the need for added heating to keep the retransferred metal in a molten condition.

Low pressure molding of metals, such as aluminum alloys for automotive components, including heads and blocks, has advanced to the use of a cast iron gatebox between the holding furnace and the die assembly or mold. A single cast iron tube extends from the bottom of the gatebox into the molten metal within the furnace. Radiant heaters may be located above the mold and around the gate box and tube to maintain the metal molten at an elevated temperature. When the mold is in a sealed metal receiving position, over the gatebox, low pressure on the metal gradually forces the molten metal to rise in the tube, fill the reservoir of the gatebox and thence flood the inlets to the base of the die cavity. Radiant or other heaters are located above the mold assembly and around the gatebox and tube to maintain the metal molten at an elevated temperature. Upon completion of metal filling of the mold, pressure is relieved in the furnace and excess molten metal in the gatebox recedes back into the furnace. The rising and receding of the molten metal contributes to the formation of small minute oxide particles in the molten metal, which oxides will eventually be present in the casting.

Multiple tubes or stalks have been deployed by the prior art but only as a direct fluid communication between the mold and furnace; only a single tube has been deployed between a gate box and furnace to the knowledge of applicants.

SUMMARY OF THE INVENTION

It is a primary object of this invention to provide a transfer system, as well as a method of transfer, that eliminates the need to return molten metal to the furnace between mold fillings by use of a plurality of stalks between a gatebox and the holding furnace, such system substantially reducing metal momentum during low pressure filling of the mold, that eliminates the need for external heat sources other than the holding furnace, that substantially reduces contamination of the molten metal from oxidation or other dissolvement of gases, and that provides more uniformity in the temperature of the molten metal that is fed to the mold.

More particularly, the invention, in a first aspect, is a transfer system for delivering molten metal against gravity from a pressurized furnace to a mold, comprising: (a) a ceramic lined refractory metal gatebox adapted to sit on or above the furnace, the gatebox having one or more openings at its top for communicating with the mold and having a plurality of metal transfer openings along its bottom; (b) a stalk tube depending from each of the gatebox bottom openings, each stalk tube being effective to extend into at least the upper region of the molten metal within the furnace; (c) a sealing gasket between the stalk tube and gatebox; (d) means for imposing a first fluid pressure on the molten metal in the furnace to gradually force the molten metal up through the stalk tubes into the gatebox to substantially fill same, said stalk tubes promoting a convection circulation of molten metal between the furnace and gatebox to retain the temperature of the molten metal in the gatebox at a difference of no greater than 5°–15° F. without the need for external heating; and (e) means for imposing a second fluid pressure on the molten metal in the furnace to quiescently force the molten metal of the substantially filled gatebox into the mold with little or no momentum effect.

The invention in a second aspect is a method of transferring molten metal from a pressurized furnace to a mold against gravity, comprising: (a) providing a ceramic lined refractory metal gatebox stationed on or above the furnace, the gatebox having smaller openings communicating with the mold thereon and having a plurality of stalk tubes communicating larger base openings of the gatebox with the upper region of the molten metal in the furnace; (b) imposing a first level of fluid pressure on molten metal in the furnace to gradually substantially fill the gatebox and retain the gatebox filled between mold changes, convective currents between said gatebox molten metal and the furnace molten metal maintaining the temperature of the molten metal in the gatebox at a temperature differential no greater than 5°–15° F.; and (c) imposing a second level of fluid pressure on the molten metal in the furnace to quiscently force the molten metal of the substantially filled gatebox into the mold with little or no momentum effect.

DETAILED DESCRIPTION AND EST MODE

Figure 1:
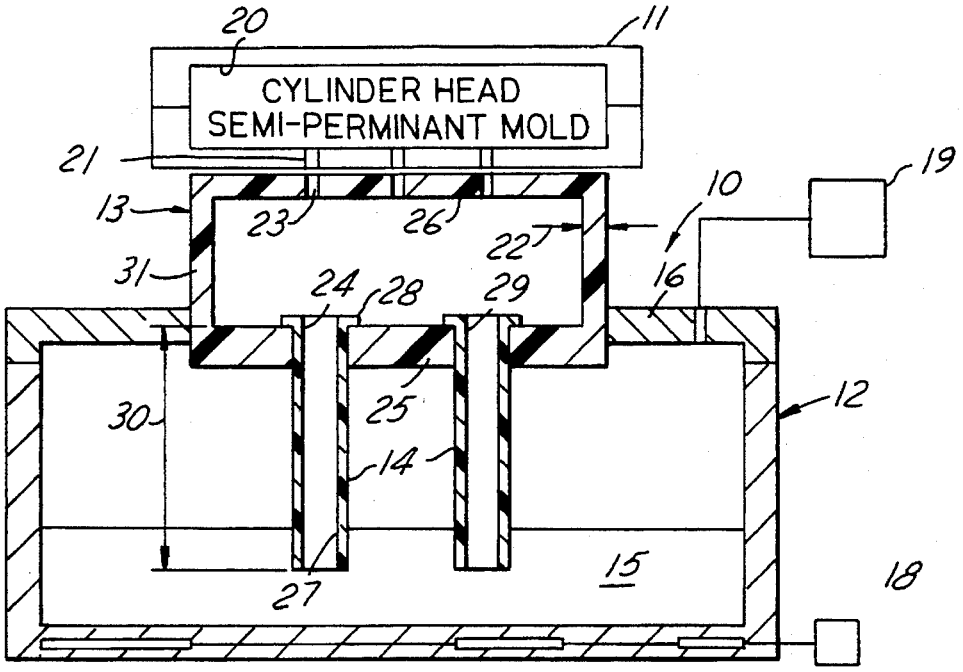
FIG. 1 is a schematic sectional evelational illustration of a mold/furnace/gatebox assembly in accordance with this invention.

As shown in FIG. 1, an apparatus assembly 10 incorporating the invention includes a mold 11, a furnace 12 and a gatebox 13 with a plurality of stalk tubes 14 depending from the gatebox into the molten metal 15 of the furnace. The mold 11 is advantageously a semi-permanent mold for making complex castings, such as an automotive engine cylinder head, having certain thin sections. The metal 15 to be cast is aluminum, such as A356 aluminum alloy, but may be any other alloy castable by low pressure means, such as for example, magnesium, zinc, lead, copper and alloys thereof. Ferrous metals may also be cast, but the type of ceramic lining must be suited to the metal that is cast.

The furnace 12 comprises a refractory lined reservoir vessel having a roof 16 that extends thereover to create an airtight enclosure 17. The furnace has provision for charging (not shown) and has means 19 for pressurizing the whole of the interior of the furnace to different pressure levels, such as in the range of 0.1–15 psi, to force the molten metal up through the stalk tubes. Thus, means 19 can serve to impose (i) a first fluid pressure on the molten metal in the furnace to gradually force such molten metal up through the stalk tubes into the gatebox to substantially fill same, and (ii) a second fluid pressure on the molten metal in the furnace to quiescently force the molten metal of the gatebox into the mold with little or no momentum effect. Depending on the size of the molten metal reservoir, 0.1 psi of pressure is needed to move aluminum up 1.0". Thus, if the stalk tube is 60" in length and has an interior diameter of 80 mm, then 5.0 psi is needed to raise the aluminum up the full length of the stalk tube and another 2.0 psi to enter into the mold. The furnace has heating apparatus 18 for heating and holding the aluminum charge therein at a melting temperature in the range of 1200°–1400° F.

The semi-permanent mold 11 is made of permanent steel cope and drag portions in a box form (or in a boxless form) and has extensive sand cores therein to define the interior walls of the cavity. Although the mold example illustrated has only one cavity 20, it may have a plurality of cavities and each may contain one or more cores. Each cavity is connected to one or more header portions of the mold by ingates 21 located along the bottom of the mold and reachable by the gatebox.

The gatebox 13 is comprised of a steel walled box lined with ceramic 31 having a thickness 22 (generally 1½" to 2½") and is of high insulative value. The ceramic consists essentially of, by weight, 50% $SiO_2$, 43% CaO, 0.3% $Al_2O_3$, and 0.3% $Fe_2O_3$ if the fibers are machine formed. If formed by vacuum, then silica will be about 82%, with 16% CaO, 0.15% $Al_2O_3$, 0.15% $Fe_2O_3$ and 0.16% MgO.

The gatebox 13 sits on or is supported above the furnace 12; it has a plurality of smaller openings 23 (i.e. 50 mm internal diameter) in its upper wall 26 communicating with the ingates 21 of the mold, and has two or more larger openings 24 (i.e. 80 mm) in its bottom wall 25 for selectively receiving the stalk tubes 14.

The stalk tubes 14 comprise metal cylinders lined with a pre-bonded fused silica. The tubes have a shoulder 28 compressing a gasket 29 surrounding the openings 24 to effect the sealing relationship. The stalk tubes must have a length 30 sufficient to extend into the molten metal 15 and preferably extend within 0.1.0" of the bottom of the body of molten metal.

The apparatus of this invention provides an internal means of heating molten aluminum in a gatebox using convection currents from molten aluminum in the furnace. The insulating characteristics of the gatebox and the location of insulated stalk tubes (with respect to the furnace) cooperate in permitting the molten aluminum in the non-externally-heated gatebox to remain hot without significant temperature loss. Heating elements 60 of silicon carbide may be located within about 3" of the stalk tubes. In addition, the apparatus provides shorter casting machine cycle times and decreased aluminum oxides.

Figure 2:
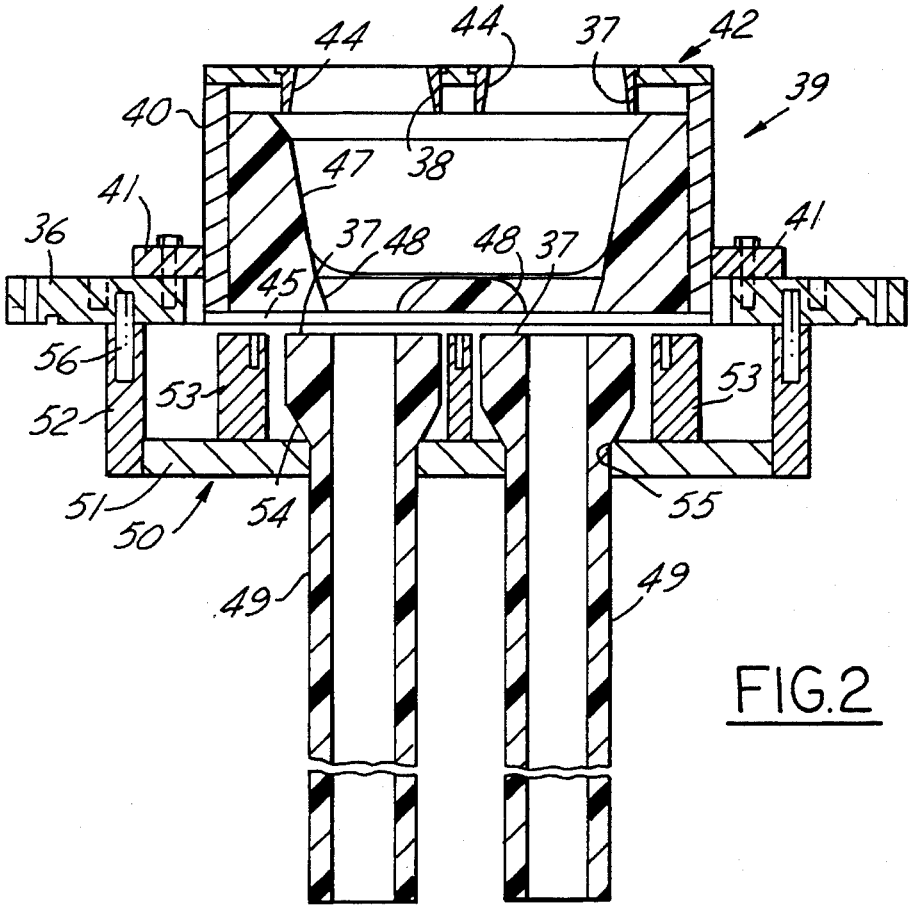
FIG. 2 is an elevational sectional view of a gatebox with stalk tubes in accordance with this invention for a commercial application to cast a 3.0 L engine cylinder head.
Figure 3:
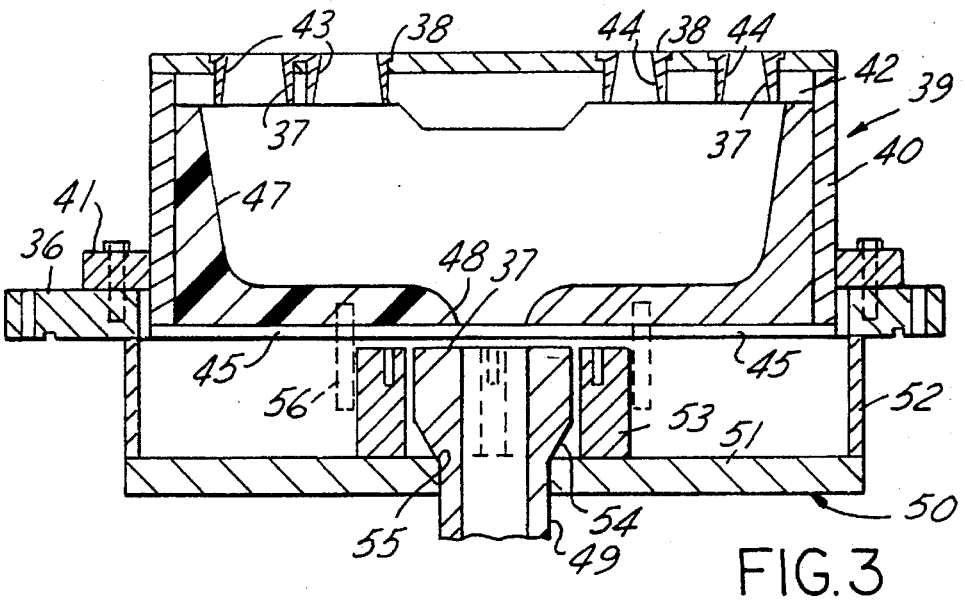
FIG. 3 is a side elevational view of the structure in FIG. 2.
Figure 4:
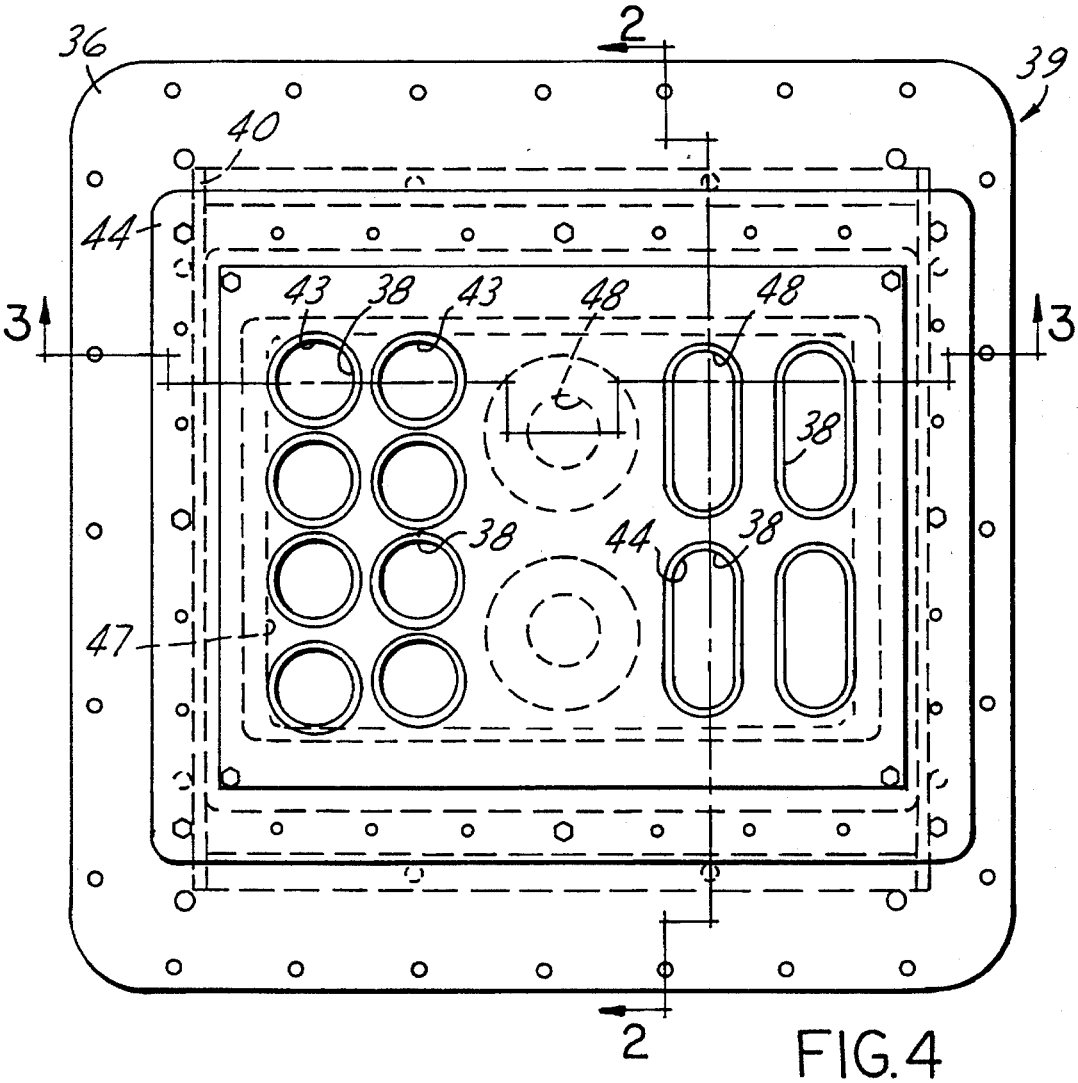
FIG. 4 is a plane view of the illustration in FIG. 3.

A commercially designed embodiment of the gatebox with depending stalk tubes is shown in FIGS. 2–4. The gatebox 39 has a metal box frame 40 with an integral peripheral bottom flange 41 and a two ply metal cover 42 provided with two rows of smaller circular openings 43 on one side and two rows of oblong smaller openings 44 on the other side. Refractory inserts 38 in each of the openings provide a slight taper to an internal surface 37 to funnel the molten metal as it rises. A bottom metallic plate 45 supports a ceramic liner 46 (here made in three layered pieces) having a bowl-like internal surface 47 draining to two larger openings 48 aligned (in plan view) between the round and oblong openings 43, 44. The plate 45 is drawn tight up to box 40 by use of a peripheral flange 36. Stalk tubes 49 are suspended from a support assembly 50 comprised of a fiat plate 51 carrying a peripheral upright wall 52 and upright collars 53. When the assembly 50 is drawn tight up against the bottom plate 45, a gasket interposed between the top of the collars, the bottom plate 45, and stalk tube shoulders 37, create a sealed relationship with the gatebox 39. The tubes have a conical shoulder 54 cradled in a complementary seat 55 of the fiat plate 51. Suitable pins 56 are used to assure alignment of the sealed assembly 50 and gatebox 39.

Figure 5:
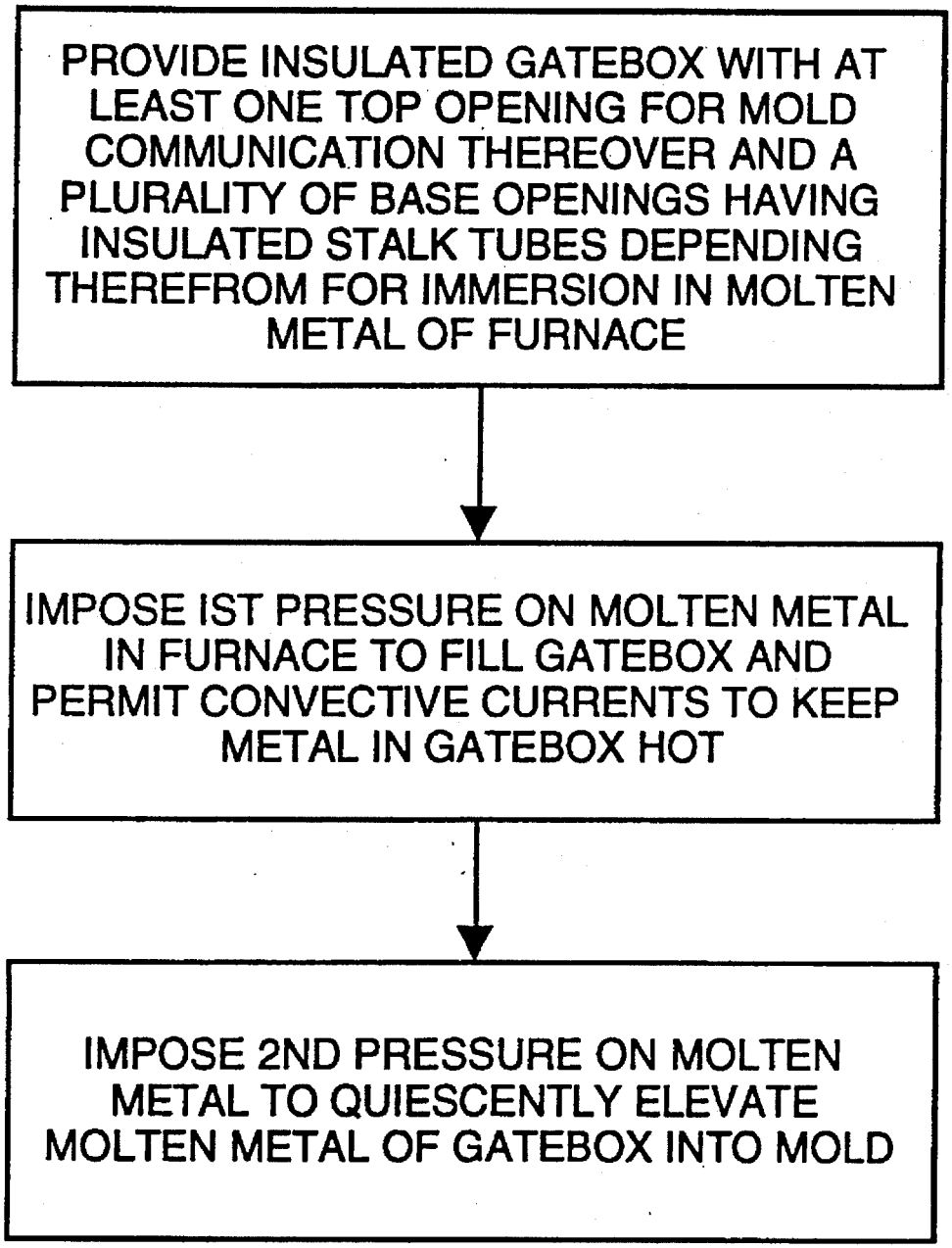
FIG. 5 is a schematic flow diagram of the process steps of this invention.

As shown in FIG. 5, the method aspect of this invention has essentially three steps. An insulated gatebox is provided with at least one top opening for mold communication (the mold being placed thereover) and with a plurality of base openings each having an insulated stalk tube depending therefrom for immersion in the molten metal of the furnace.

Next, a first fluid pressure is imposed on the molten metal in the furnace to cause such metal to rise, counter-gravity, through the stalk tubes into the gatebox and, essentially fill the gatebox. After filling, the stalk tubes, having an internal diameter in excess of 80 mm, permit convection currents to move some molten between the molten aluminum in the furnace, up through the stalk tubes, and about the molten aluminum in the gatebox. This allows cooler molten aluminum to flow back to the furnace with hotter molten aluminum rising into the gatebox. The gatebox molten metal, if aluminum, will remain within 5°–15° F. of the temperature of the metal in the furnace.

Lastly, a second higher fluid pressure is imposed on the molten aluminum in the furnace to force the gatebox metal through the ingates into the mold cavity.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A transfer system for delivering molten metal against gravity from a pressurized furnace to a mold, comprising:

(a) ceramic lined refractory metal gatebox adapted to sit on or above said furnace, said gatebox having one or more openings at its top for communication with the mold and having a plurality of metal transfer openings along its bottom;

(b) a stalk tube depending from each of said gatebox bottom openings, each stalk tube being effective to extend into at least the upper region of the molten metal within said furnace;

(c) a sealing gasket between said stalk tube and gatebox;

(d) means for imposing a first fluid pressure on said molten metal in the furnace to gradually force such molten metal up through said stalk tubes into said gatebox to substantially fill same and keep said gatebox continuously filled, said stalk tube promoting a convection circulation of metal between said furnace and gatebox to retain the temperature of the molten metal in the gatebox at a temperature differential no greater than 5°–15° F. without the need for external heating, and (e) means for imposing a second fluid pressure on the molten metal in the furnace to quiescently force the molten metal of said gatebox into the mold with little or no momentum effect.

2. The transfer system as in claim 1, in which the lining of said gatebox and stalk tubes is a fused silica in the thickness range of 1½" to 2½".

3. The transfer system as in claim 2, in which said fused silica is predominately of $SiO_2$, accompanied by CaO, minor amounts of $Al_2O_3$, and $Fe_2O_3$.

4. The transfer system as in claim 1, in which the first fluid pressure level is in an amount of 2.8 psi, proportioned to apply approximately 0.1 psi for each one inch of elevation required.

5. The transfer system as in claim 4, in which the second fluid pressure level is above 1.5 psi necessary to move the metal into the mold.

6. The transfer system as in claim 1, in which the temperature range of the molten metal in the furnace is approximately 1350° F. and the temperature range for the molten metal retained in the gatebox is in the range of 1335°–1345° F.

7. A method of transferring molten metal from a pressurized furnace to a mold against gravity, comprising:

(a) providing an insulated refractory metal gatebox stationed on or above said furnace, said gatebox having one or more smaller openings communicating with the mold thereon and having a plurality of stalk tubes communicating larger base openings of the gatebox with at least the upper region of said molten metal in the furnace;

(b) imposing a first level of fluid pressure on said molten metal in the furnace to gradually substantially fill the gatebox and retain said gatebox filled between casting cycles, convective currents between said gatebox molten metal and furnace molten metal maintaining the temperature of the molten metal in the gatebox at a temperature differential no greater than 5°–15° F.; and (c) imposing a second level of fluid pressure on the molten metal in the furnace to quiescently force the molten metal of the substantially filled gatebox into the mold with little or no momentum effect.

* * * * *